US006719407B2

(12) United States Patent
Kobayashi

(10) Patent No.: US 6,719,407 B2
(45) Date of Patent: Apr. 13, 2004

(54) THERMAL HEAD

(75) Inventor: Hiroshi Kobayashi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/303,512

(22) Filed: Nov. 25, 2002

(65) Prior Publication Data

US 2003/0103113 A1 Jun. 5, 2003

(30) Foreign Application Priority Data

Dec. 3, 2001 (JP) ..... 2001-368735

(51) Int. Cl.[7] ..... B41J 2/05; B41J 2/335; B41J 2/34

(52) U.S. Cl. ..... 347/64; 347/202; 347/203; 347/204

(58) Field of Search ..... 347/64, 202, 203, 347/204, 205

(56) References Cited

U.S. PATENT DOCUMENTS 5,091,736 A * 2/1992 Narita ..... 347/208
6,614,460 B2 * 9/2003 Susukida et al. ..... 347/200

FOREIGN PATENT DOCUMENTS

| | | | |
|---|---|---|---|
| DE | 4422975 A1 * | 1/1995 | ..... B41J/2/235 |
| JP | 7-81113 | 3/1995 | |
| JP | 8-80628 | 3/1996 | |

* cited by examiner

*Primary Examiner*—Judy Nguyen
*Assistant Examiner*—Alfred E Dudding
(74) *Attorney, Agent, or Firm*—Brinks Hofer Gilson & Lione

(57) ABSTRACT

In a thermal head capable of performing printing of high quality while preventing foreign matters such as dirt or the like from accumulating in a portion, on which a heat reserving layer is formed, at the time of printing, the heat reserving layer comprising a projection formed by partially projecting a surface of the layer and having a top, the projection being provided on a surface thereof with heating elements, the projection being shaped in cross section in a direction perpendicular to a direction of arrangement of the heating elements to form an inclined surface on one surface side, which is formed to be lower than the other surface side. The projection is formed so that a height thereof from the one surface side is 5 to 50 $\mu$m.

2 Claims, 2 Drawing Sheets

THERMAL HEAD

BACKGROUND OF THE INVENTION

The invention relates to a thermal head for use in thermal printers, and more particularly, to a thermal head capable of preventing degradation in print quality, caused by adherence of dirt or the like.

Generally, a thermal head as a recording head mounted on a thermal printer or the like comprises a plurality of heating elements composed of a heating resistor and aligned in a row on a substrate, and the heating elements are selectively energized according to printing information to generate heat, thereby melting ink on an ink ribbon to heat transfer the same to regular paper, paper for OHP (overhead projector), or the like, or to cause a thermal recording paper to take color, so that printing on recording media of various kinds is performed.

With such conventional thermal head, it is general as shown in FIG. 3 that a heat reserving layer 12 is formed on an upper surface of a radiating substrate 11 and a projection 12*b* is formed on an upper surface of the heat reserving layer 12 and near one end 11*a,* which constitutes a right side end of the substrate 11, to project a predetermined height.

Also, a heating resistor 13 is laminatingly formed on the upper surface of the heat reserving layer 12, and a common electrode 14 and an individual electrode 15 are formed on the left and right of the heating register 13 to supply electric power energy to the heating resistor 13.

A plurality of heating elements 13*a* are aligned in a dot-shaped manner and formed in a location between the common electrode 14 and the individual electrode 15 of the heating resistor 13.

Also, protective layers (not shown) are laminatingly formed on upper surfaces of the heating elements 13*a,* the common electrode 14 and the individual electrode 15 to prevent oxidation and abrasion of the heating elements 13*a,* and the respective electrodes 14, 15.

Also, as shown in FIG. 4, a driver IC 16 is arranged on a left side of the projection 12*b* in the figure and near the other end 11*b* of the substrate 11 to be connected to the common electrode 14 and the individual electrode 15.

Also, a terminal portion 17 formed from a FPC (flexible substrate) or the like is taken out from the other end 11*b* of the substrate 11.

With such conventional thermal head, the substrate 11 is mounted on a head mount (not shown) to be mounted on a thermal printer for printing, at which the head mount is turned to bring the thermal head into pressure contact with a platen (not shown), whereby the heating elements 13*a* can be brought into pressure contact with, for example, an ink ribbon 18.

In the case where a printer mounting thereon the conventional thermal head described above is a thermal transfer printer, the thermal head 11 is lowered to bring the heating elements 13*a* into pressure contact with the ink ribbon 18 and to move the thermal head 11 in a direction indicated by an arrow A.

Then, the heating elements 13*a* is caused on the basis of printing information to selectively generate heat to heat the ink ribbon 18, whereby ink on the ink ribbon 18 is transferred to a recording sheet 19 to afford printing characters, images or the like on the recording sheet 19.

Also, with a thermal transfer printer of line type, printing on the recording sheet 19 can be performed while moving the ink ribbon 18 and the recording sheet 19 in a direction indicated by an arrow B without moving the thermal head.

With conventional thermal heads, however, recesses 12*c,* 12*d* are produced on the surface of the heat reserving layer 12 and on right and left feet of the projection 12*b* of a predetermined height in the figure.

Therefore, when ink in the ink ribbon 18 is transferred to the recording sheet 19 placed on a platen (not shown) for printing while the thermal head 11 with its head lowered is moved in the direction of the arrow A, it is feared that foreign matters, such as fine dirt or the like, attaching to the ink ribbon 18 accumulate in the recess 12*c* on a left side of the heating elements 13*a* in the figure and upstream of the projection 12*b* in the direction of movement indicated by the arrow A.

When foreign matters such as dirt or the like accumulate in the recess 12*c* on the left side of the heating elements 13*a* in the figure as described above, it is feared that striped white lines or the like are generated on a picture image printed on the recording sheet 19 under the influence of dirt or the like to cause degradation in quality of printing.

Also, in the case where printing is performed while the ink ribbon 18 and the recording sheet 19 are moved in the direction of the arrow B and without moving the thermal head 11, it is feared that foreign matters such as dirt or the like accumulate in the recess 12*c* on the left side of the heating elements 13*a* in the figure.

SUMMARY OF THE INVENTION

The invention has been thought of in view of the above problem, and has its object to provide a thermal head capable of performing printing of high quality by preventing foreign matters such as dirt or the like at the time of printing to accumulate in a location where a heat reserving layer is formed.

The invention provides, as first solving measures for solving the above problem, a thermal head comprising a heat reserving layer formed on a surface of a substrate, a plurality of heating elements formed on an upper surface of the heat reserving layer, an individual electrode and a common electrode for supplying electricity to the heating elements, and a protective layer covering at least upper surfaces of the heating elements, the individual electrode and the common electrode, and wherein the heat reserving layer comprise a projection formed by partially projecting a surface of the layer, the heating elements being provided on a surface of the projection, and the projection is shaped in cross section in a direction perpendicular to a direction of arrangement of the heating elements to form an inclined surface on one surface side thereof, the other surface side thereof being formed to be flat in substantially the same height as that of a top of the projection.

Also, as second solving measures for solving the above problem, a height of the projection from the one surface side is 5 to 50 $\mu$m.

Also, as third solving measures for solving the above problem, the common electrode is formed on the one surface side and the individual electrode is formed on the other surface side.

DETAILED DESCRIPTION OF PREFERRED EMBODIMENTS

Figure 1:
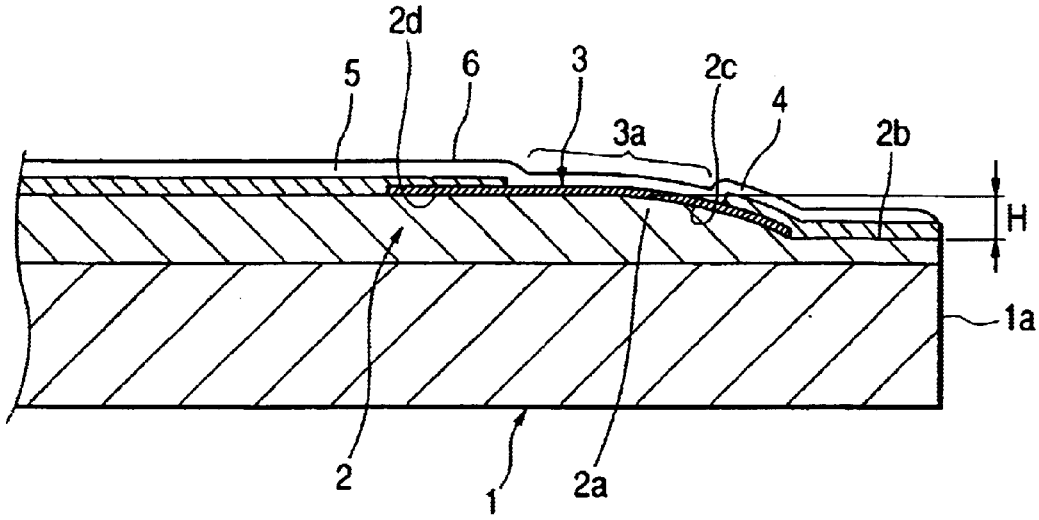
FIG. 1 is a cross sectional view showing an essential part of a thermal head according to the invention.
Figure 2:
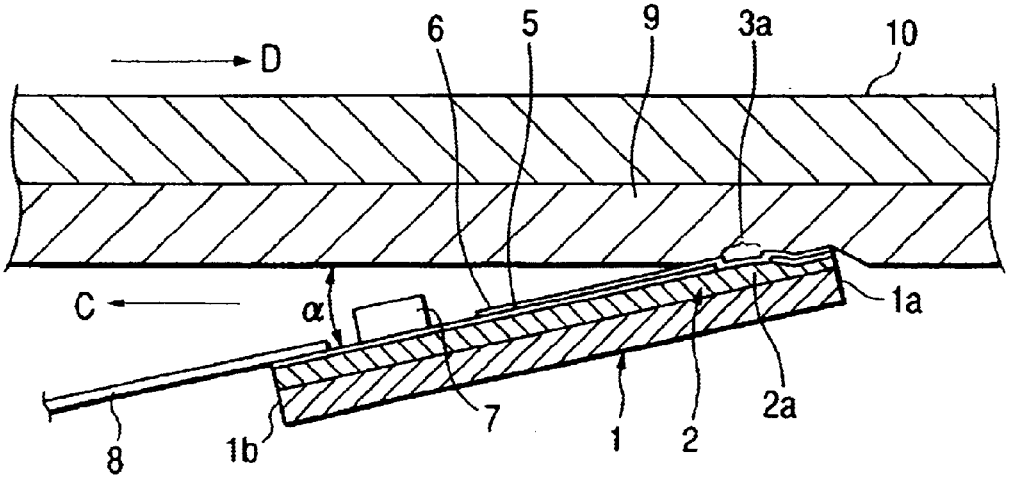
FIG. 2 is a schematic view showing the printing operation performed by the thermal head according to the invention.
Figure 3:
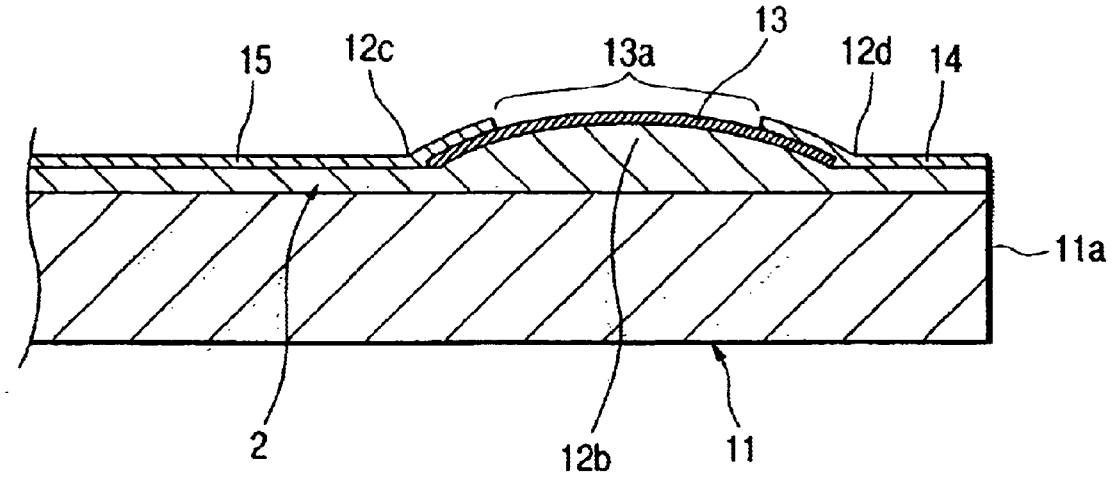
FIG. 3 PRIOR ART
FIG. 3 is a cross sectional view showing an essential part of a conventional thermal head.
Figure 4:
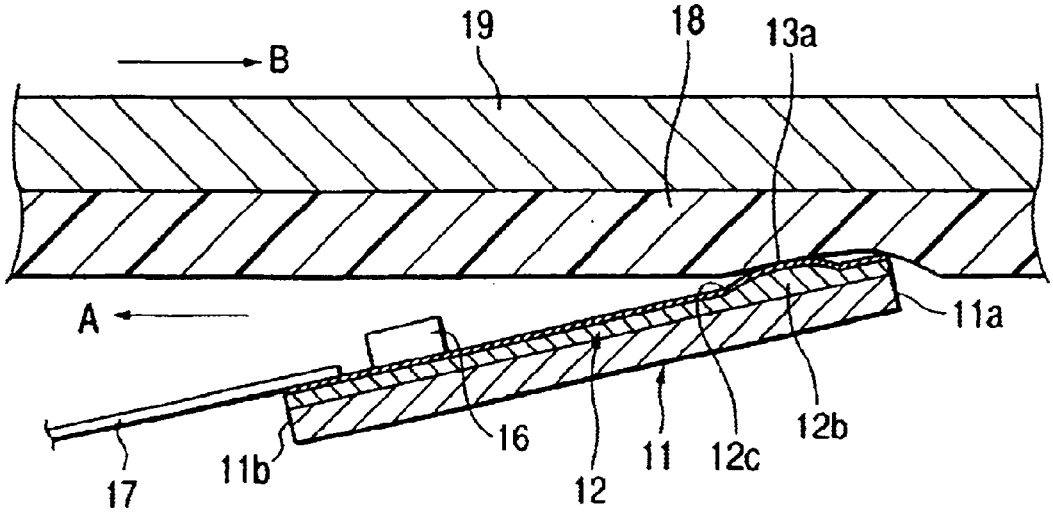
FIG. 4 PRIOR ART
FIG. 4 is a schematic view showing the printing operation performed by the conventional thermal head.

A thermal head according to the invention will be described below with reference to the drawings. FIG. 1 is a cross sectional view showing an essential part of a thermal head according to the invention, and FIG. 2 is a schematic view showing the printing operation performed by the thermal head according to the invention.

First, the thermal head according to the invention comprises, as shown in FIG. 1, a substrate 1 having a good heat dissipation and a heat reserving layer 2 composed of a glaze having a good heat reserving quality and formed on an upper surface of the substrate 1.

A photolithographic technique or the like is used to partially project a surface of the heat reserving layer 2 to form a projection 2*a*.

The projection 2*a* is shaped in cross section in a direction perpendicular to a direction of arrangement of heating elements 3*a* described later to form an inclined surface 2*c* on one surface side 2*b* disposed on a right side in the figure, the one surface side 2*b* being formed to be lower than the other surface side 2*d* disposed on a left side of the projection 2*a* in the figure.

Further, the projection 2*a* is formed by the inclined surface 2*c* to be gently inclined toward the one surface side 2*b* from the other surface side 2*d*. Therefore, the heat reserving layer 2 is shaped in cross section to be made stepwise by the inclined surface 2*c*.

Also, the other surface side 2*d* of the projection 2*a* is formed flat in substantially the same level as that of the projection 2*a*.

The projection 2*a* is formed near one end la being a right end of the substrate 1 in the figure. Also, the projection 2*a* is formed such that a height H from the one surface side 2*b* is in the range of 5 to 50 $\mu$m.

Also, a heating resistor 3 formed from Ta-N, Ta-SiO2 or the like is laminatingly formed on an upper surface of the heat reserving layer 2 by means of sputtering or the like.

Also, sputtering of Al, Cu, Au or the like and the photolithographic technique are used to laminate and pattern form a common electrode 4 on the inclined surface 2*c* and an individual electrode 5 on the other surface side 2*d*, which electrodes supply electric power energy to the heating resistor 3, on the upper surface of the heating resistor 3.

Besides, a portion interposed between the respective electrodes 4, 5 of the heating resistor 3 is aligned in a dot-shaped manner to provide a plurality of heating elements 3*a*.

Formed on upper surfaces of the heating resistor 3, the common electrode 4, and the individual electrode 5 by means of sputtering or the like to cover them with a predetermined thickness are a protective layer 6 formed from a hard ceramic such as Si-O-N, SiAlON or the like having excellent oxidation resistance and abrasion resistance for preventing oxidation and abrasion of the heating resistor 3, the common electrode 4, and the individual electrode 5.

Also, a driver IC 7 to be connected to the common electrode 4 and the individual electrode 5 is arranged on a left side of the heating elements 3*a* and on the heat reserving layer 2 near the other end 1*b* of the substrate 1.

The driver IC 7 is adapted to control voltage of current-carrying pulse supplied to, for example, the plurality of heating elements 3*a* to control the calorific power of the heating elements 3*a*.

Also, an external terminal 8 formed from a FPC (flexible substrate) or the like and connected to a terminal of the driver IC 7 is taken out from the heat reserving layer 2 near the other end 1*b* of the substrate 1.

Such thermal head according to the invention is mounted on a head mount (not shown) having a good heat dissipation so that heat accumulated in the heat reserving layer 2 during printing is dissipated through the substrate 1.

Also, the head mount is supported on a carriage (not shown) on a side of a printer to be able to turn. In the case where a printer making use of the thermal head according to the invention is a thermal transfer printer, the head mount is turned whereby the thermal head is lowered in a head-down manner to enable the heating elements 3*a* to come into pressure contact with an ink ribbon 9.

In a state, in which the thermal head 1 is lowered in a head-down manner, the carriage (not shown) is moved to move the thermal head in a direction indicated by an arrow C and selective energizing of the heating elements 3*a* on the basis of printing information causes the heating elements 3*a* to generate Joule heat for selective heating.

Such heating of the heating elements 3*a* causes selective heating of the ink ribbon 9, so that ink (not shown) in the ink ribbon 9 is transferred to be able to print characters, picture image or the like on a recording sheet 10 disposed on a platen (not shown).

At the time of such printing, a pressure contact angle $\alpha$ of the thermal head 1 relative to the recording sheet 9 is set in the range of 1 to 30 degrees.

Further, since a top of the projection 2*a* of the heat reserving layer 2 and the other surface side 2*d* are formed in substantially the same level, the recess 12*c* as illustrated in relation to the conventional thermal head 11 can be dispensed with.

Therefore, even if foreign matters such as dirt or the like are present on the surface of the recording sheet 9 when the thermal head lowered in a head-down manner is moved in the direction of the arrow C, the heating elements 3*a* can get over such foreign matters, so that such foreign matters will not remain and accumulate in a particular location on the thermal head 1.

Also, the pressure contact angle $\alpha$ of the thermal head relative to the recording sheet 10 is set to be in the range of 1 to 30 degrees, whereby the heating elements 3*a* formed over the gently inclined surface 2*c* can be efficiently brought into pressure contact with the ink ribbon 9 or a thermosensible paper (not shown),and so load of pressure contact exerted by the thermal head 1 can be concentratedly applied on the heating elements 3*a*. Therefore, it is possible to perform printing of high quality.

Also, in the case where the thermal head is of line head, type, picture images such as characters or the like can be printed on a recording sheet 10 by, for example, moving the ink ribbon 9 and the recording sheet 10 in a direction indicated by an arrow D without moving the thermal head.

Alternatively, with a direct thermal printer, the heating elements 3*a* are caused to come into direct pressure contact with a thermosensible paper (not shown) whereby the thermosensible paper is made to take color, thus enabling printing.

In addition, the heat reserving layer 2 may be formed such that the one surface side 2*b* of the projection 2*a* erects directly from the surface of the substrate 1.

With the thermal head according to the invention, since the projection is shaped in cross section in a direction perpendicular to a direction of arrangement of the heating elements to form the inclined surface on the one surface side and to form the other surface side in substantially the same level as that of the top surface of the projection, possible foreign matters, such as fine dirt or the like, present at the time of printing will not remain on the one surface side.

Therefore, it is possible to print a picture image of high print quality, in which no white lines or the like are generated under the influence of foreign matters or the like.

Also, since the thermal head according to the invention is formed such that a height H of the top of the projection from the one surface side is 5 to 50 $\mu$m, it is possible to prevent foreign matters such as dirt or the like from accumulating on a foot of the other surface side.

Also, since the common electrode is formed on the one surface side and the individual electrode is formed on the other surface side being flat, a pattern configuration can be enhanced in accuracy and minute patterning is possible. Thereafter, it is possible to process a thermal head of high resolution.

What is claimed is:

1. A thermal head comprising:

a heat reserving layer formed on a surface of a substrate;

a plurality of heating elements formed on an upper surface of the heat reserving layer;

an individual electrode and a common electrode that supply electricity to the heating elements; and a protective layer covering upper surfaces of the heating elements, the individual electrode and the common electrode, wherein the heat reserving layer comprises a projection formed by partially projecting a surface of the heat reserving layer, the heating elements being provided on a surface of the projection, and the projection is shaped in cross section in a direction perpendicular to a direction of arrangement of the heating elements to form an inclined surface on one surface side thereof, the other surface side thereof being formed to be flat in substantially a same height as that of a top of the projection, and wherein a height of the protection from the one surface side is 5 to 50 $\mu$m.

2. The thermal head according to claim 1, wherein the common electrode is formed on the one surface side and the individual electrode is formed on the other surface side.

* * * * *

UNITED STATES PATENT AND TRADEMARK OFFICE

CERTIFICATE OF CORRECTION

PATENT NO. : 6,719,407 B2
DATED : April 13, 2004
INVENTOR(S) : Hiroshi Kobayashi It is certified that error appears in the above-identified patent and that said Letters Patent is hereby corrected as shown below:

Column 6,
Line 13, delete “protection” and substitute -- projection -- in its place.

Signed and Sealed this

Fourteenth Day of December, 2004

JON W. DUDAS
*Director of the United States Patent and Trademark Office*